United States Patent [19]

Goller et al.

[11] Patent Number: 4,700,553

[45] Date of Patent: Oct. 20, 1987

[54] YARN TENSIONING DEVICE FOR FLAT KNITTING MACHINES

[75] Inventors: Ernst Goller, Reutligen; Fritz Walker, Kusterdingen, both of Fed. Rep. of Germany

[73] Assignee: H. Stoll GmbH & Co., Fed. Rep. of Germany

[21] Appl. No.: 6,850

[22] Filed: Jan. 27, 1987

[30] Foreign Application Priority Data

Jan. 28, 1986 [DE] Fed. Rep. of Germany ..... 3602431

[51] Int. Cl.[4] ..... D04B 15/44

[52] U.S. Cl. ..... 66/146 R; 242/147 R; 242/154

[58] Field of Search ..... 66/146, 160, 125, 132, 66/145; 242/147 R, 153, 154

[56] References Cited

U.S. PATENT DOCUMENTS 4,250,722 2/1981 Betts et al. ..... 66/146

4,526,019 7/1985 Betts et al. ..... 66/146 X

*Primary Examiner*—Ronald Feldbaum

*Attorney, Agent, or Firm*—Larson and Taylor

[57] ABSTRACT

The yarn tensioning device for flat knitting machines has for each yarn (20) to be processed a pivotable support (23), for yarn guide members (25–31), located in the region of an end of a needle bed, preferably outside a covering panel (16) of the machine. Each pivotable support 23 has on a projecting part (23*b*) a yarn clamp (35) which enters the covering panel (16) through an aperture (22) and constitutes an auxiliary member during threading of the yarn. The pivotable support (23) also carries the yarn take-up (31/32) and a number of adjustment and control members of the yarn tensioning device.

10 Claims, 6 Drawing Figures

YARN TENSIONING DEVICE FOR FLAT KNITTING MACHINES

Figure 1:
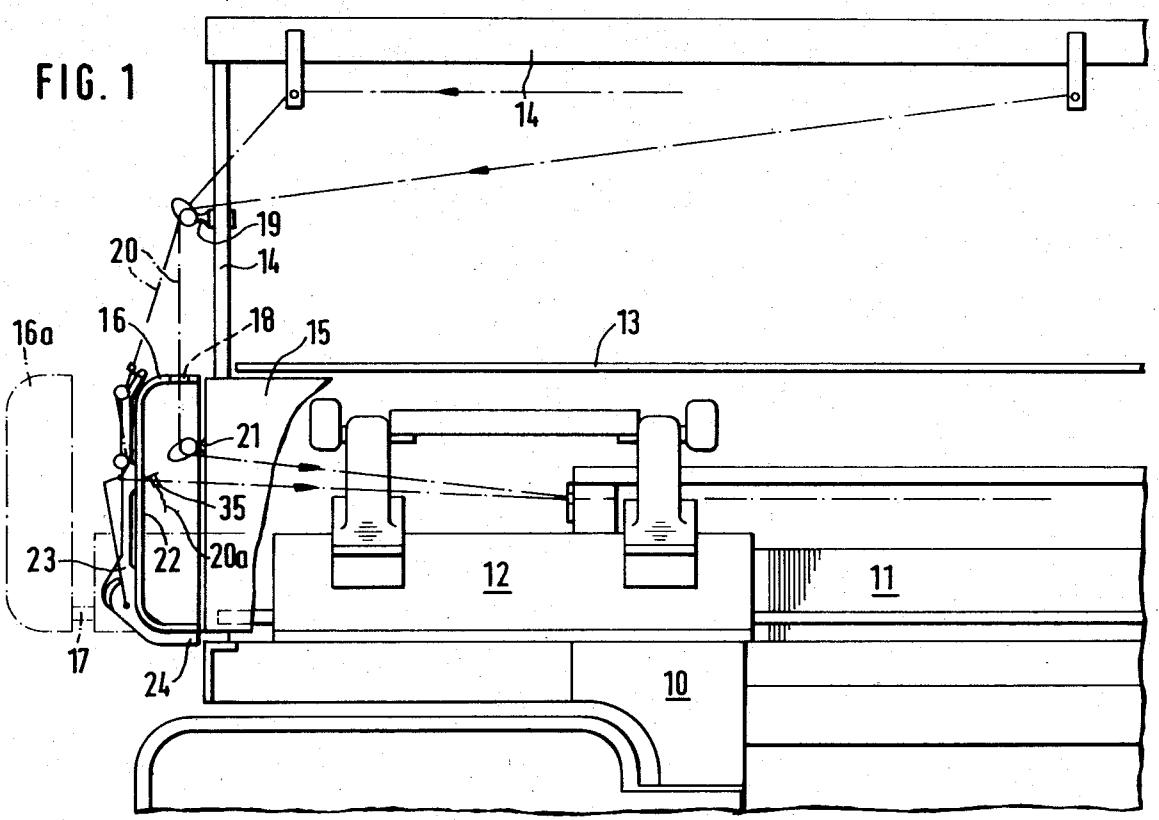

The invention relates to a yarn tensioning device for flat knitting machines having, for each yarn which is provided for, yarn guide members, at least one yarn brake and a pivoted spring-loaded lever carrying a yarn guide member and located between two yarn guide members, to serve as yarn take-up tensioner.

Yarn tensioning devices of the kind set out in the introduction are known in many forms. In flat knitting machines, the yarns must always be guided from the ends of the needle beds to the yarn feeders. Problems arise here with respect to the guiding of the yarns and especially during insertion of the yarns, if a large number of yarns have to be guided in the region of the needle bed ends and if the flat knitting machine is also provided in the region of the needle bed ends with a safety or sound insulation cover. The arrangement of a number of yarn guide members in a row makes the threading of the yarns in the individual yarn guide sections more difficult.

The object of the invention is to construct a yarn tensioning device of the kind set out in the introduction such that an orderly guiding of the yarns is ensured in the region of the needle bed end and the threading of the individual yarns in the yarn guide members and as far as the yarn feeders is made easier.

The object set forth is achieved, according to the invention, in a yarn tensioning device of the kind set out in the introduction in that the take-up tensioner and at least the yarn guide members located in front of it and behind it in the direction of yarn movement are mounted on a common support pivotable out of its operative position for threading up, which has, additionally, behind the take-up tensioner in the direction of yarn movement, a yarn clamp to assist in threading up and to which the yarn is led over a yarn guide roller stationarily mounted on the machine housing. Advantageously, there can be provided here a separate pivotable support for each yarn brought into use and the supports can be arranged adjacent one another on a common pivot axle, and whereas the yarns are supplied over yarn guide rollers also arranged adjacent one another on a common stationary axle.

By means of the pivotable support, a section of the yarn guide members provided in the yarn path in the region of the end of the machine can be brought into a position in which they become easily accessible for an operator and the threading of the yarn is made easier for the operator. By means of the yarn clamp arranged behind the take-up tensioner, a yarn to be threaded can be temporarily secured whilst the support is swung back into its operative position. This temporary securing is especially advantageous in flat knitting machines provided with a protective panel in the region of the needle bed ends, where the pivotable support can, according to the invention, be located outside this covering panel and the covering panel has at least one aperture, through which the yarn coming from a support enters and into which the yarn clamp of the support extends, according to the invention, in the operative position of the support. The yarn held in the yarn clamp can, after the support has been swung back into its operative position, be grasped by the operator inside the covering panel and pulled further to the associated yarn feeder.

The yarn tensioning device constructed according to the invention with its pivotable supports produces the further advantage that the pivotable supports with their yarn guide members can be separately constructed in advance and can be built onto the flat knitting machine as pre-constructed units. This permits a substantially more exact construction of the individual yarn guide members and associated electrical control devices than would be possible if these parts were individually mounted on a flat knitting machine. Thus the yarn tensioning device for the individual yarns on the pivotable support can have an adjustable switching stop for alteration of the maximum pivot angle of the spring-loaded pivot lever of the take-up tensioner, by which the switching-off of the machine is achieved. By adjustment of the switching stop, the stopping point can be adjusted to a shorter reaction time, in each case subject to the requirements of yarn take-up. Additionally, the pivoted lever of the yarn take-up can act on an electrically operated switching element dependent on the pivot angle. By means of this characteristic, the quantity of yarn delivered to a yarn feeder at any time, especially from an intermediate store, can be determined by the precise yarn feed ensured by the yarn tensioning device, which is of importance, especially when knitting to shape.

The reliable yarn feed is also promoted by the construction of the stationarily mounted yarn feed rollers located in the direction of yarn movement, in advance of the pivotable supports. The yarn feed rollers, according to the invention, can be pushed onto a common axle secured on the machine frame, with the interposition of spacing discs. The spacing discs each have a radial arm which is provided with an inclined safety finger and an aperture and wherein the radial arms of all the spacing discs are aligned and the free end of the safety peg of a radial arm extends into the aperture of a neighbouring radial arm. The profiled spacing discs can thus be suitably formed as unitary bodies of metal or sythetic material. The safety finger covers the whole gap between two spacing discs, so that a yarn can, with certainty, not escape from the roller track. A desired number of yarn guide rollers can be secured on the machine frame and co-ordinated as a unit with the following pivotable supports.

An embodiment of the subject matter of the invention will be described in greater detail below with reference to the accompanying drawings.

Figure 2:
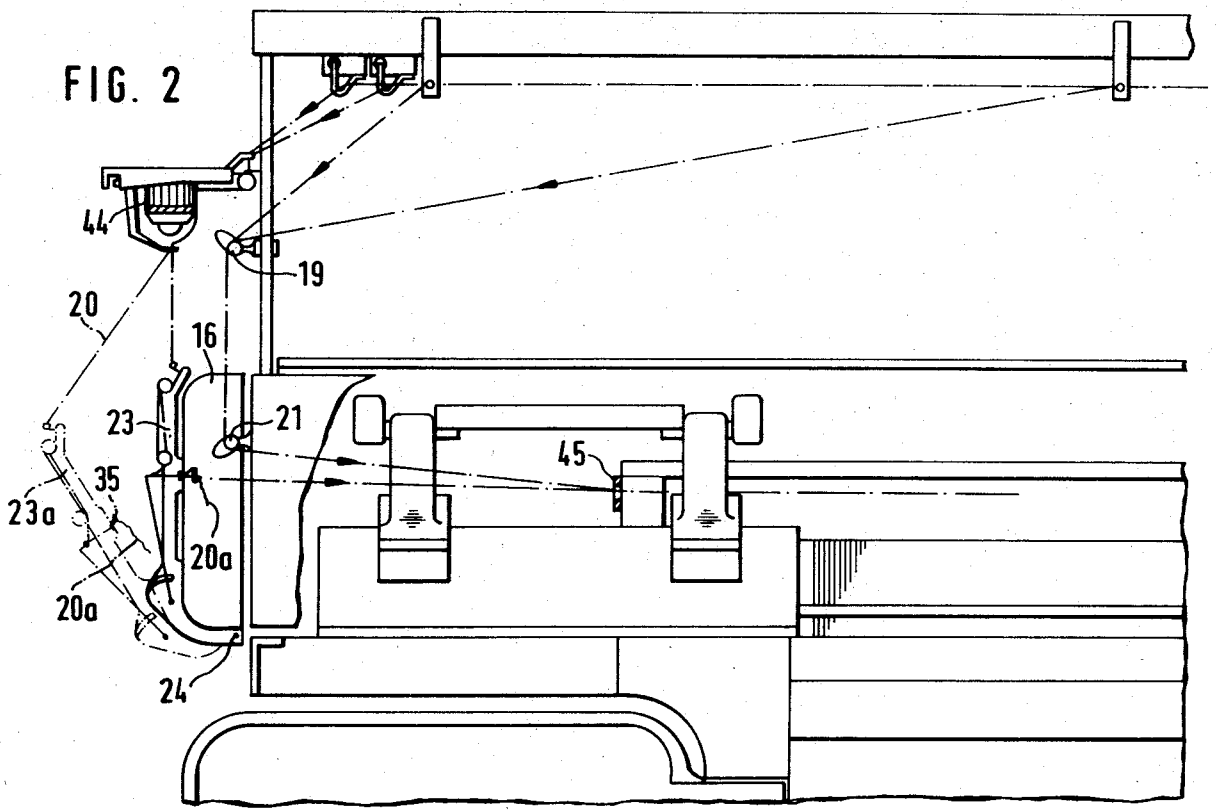
Figure 3:
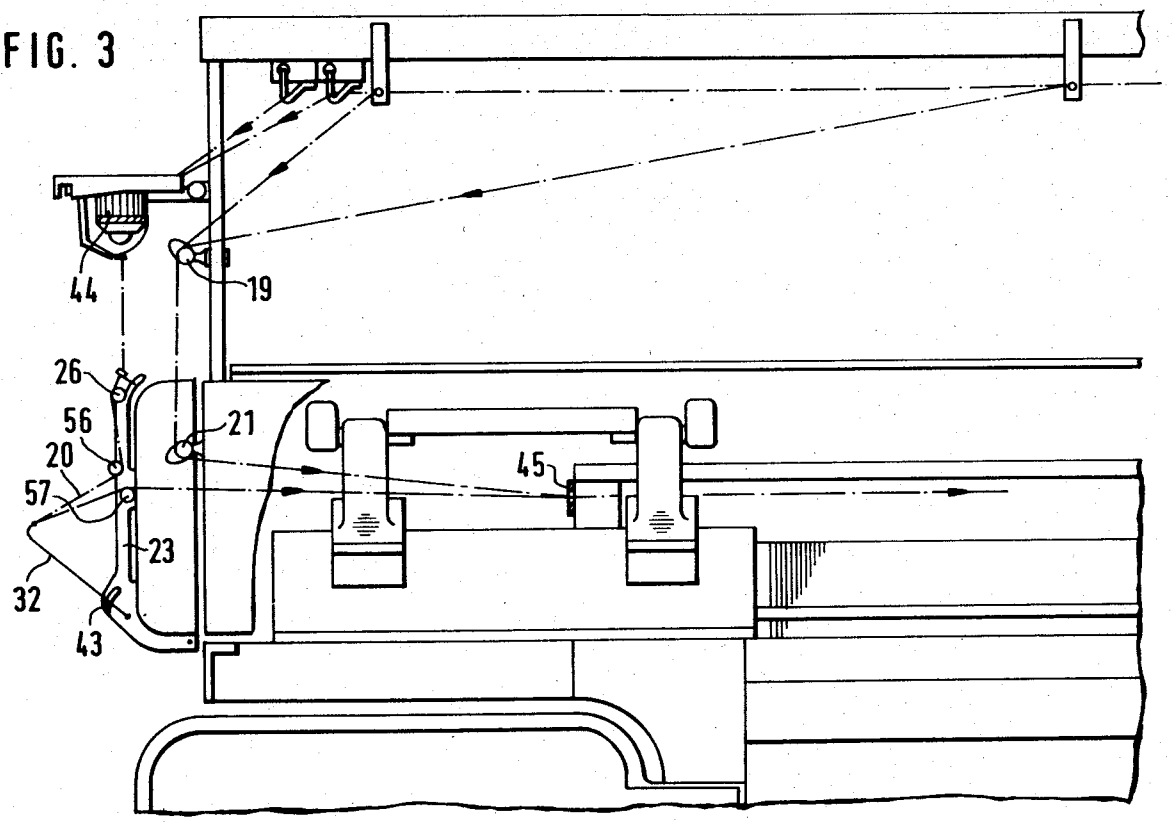
Figure 4:
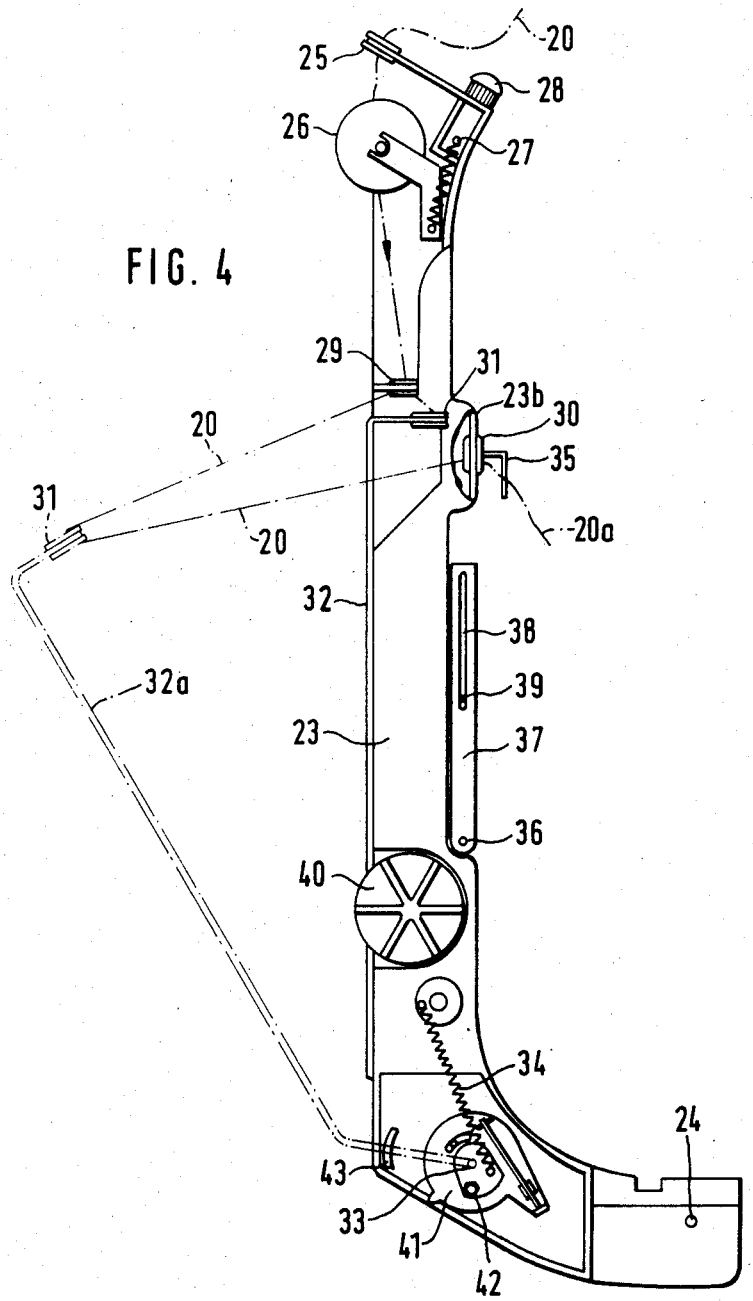
Figure 5:
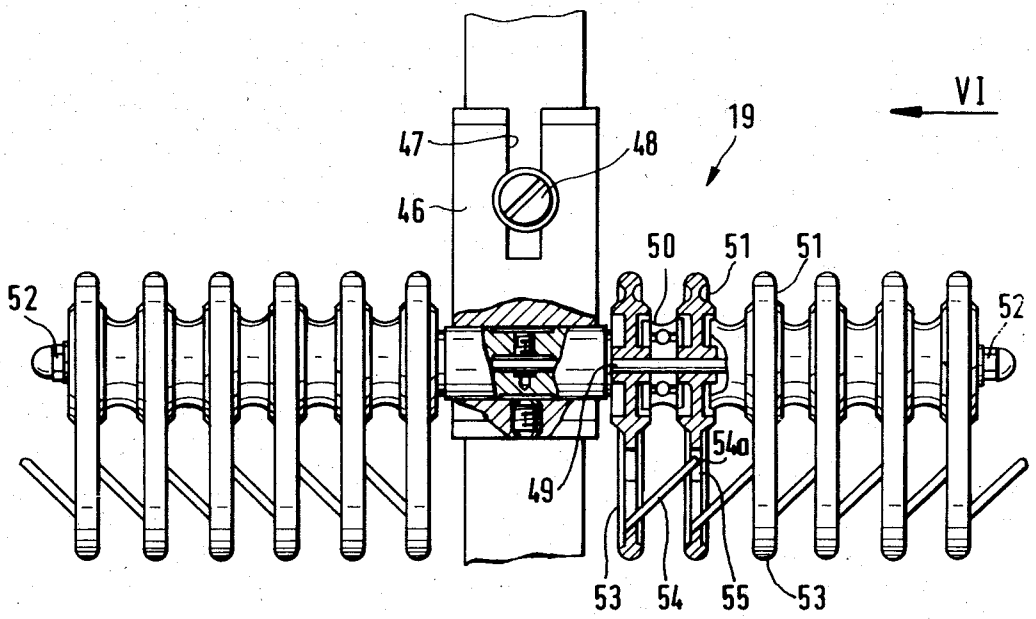
Figure 6:
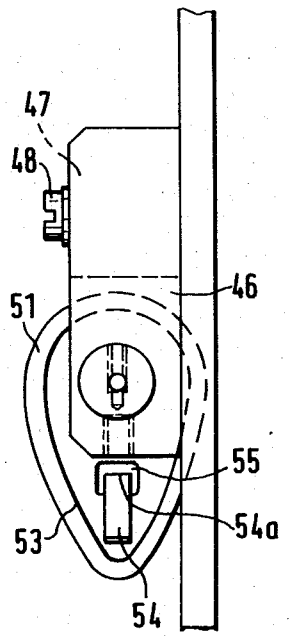

Individually, these show:

FIG. 1 a schematic front view of the end region of a needle bed of a flat knitting machine with a yarn tensioning device and provided with a covering panel;

FIG. 2 a front view corresponding to FIG. 1 with, to some extent, different yarn guide members;

FIG. 3 a front view corresponding to FIG. 1 with an outwardly pivoted yarn take-up tensioner of one yarn guide path;

FIG. 4 a detail view of a pivotable support of a yarn tensioning device having various yarn guide members including the yarn take-up tensioner;

FIG. 5 a detail view of a unit of yarn guide rollers of the yarn tensioning device in front view and partly in section;

FIG. 6 a side view of the unit of yarn guide rollers in the direction of the arrow VI in FIG. 5.

In the schematic part front view of FIGS. 1 to 3, there are visible, a part of a side foot 10 of a flat knitting machine, the cam carriage 12 of the machine located at the end of the needle bed 11, a bobbin support table 13 and a yarn guide support 14. In addition, a front covering panel 15 and a side covering panel 16 of a sound insulation cover of the flat knitting machine are illustrated schematically.

FIG. 1 shows the side covering panel 16, in chain-dotted lines, in a lifted-off position 16*a*, to which it can be moved, mounted on guide rods 17. The side covering panel 16 has on its upper side a slit-shaped aperture 18, through which yarns running from a yarn guide roller arrangement 19, mounted so as to be stationary on the yarn guide support 14, can be led directly behind the cover to a yarn guide roller unit 21 located there. A further aperture 22 to allow through passage of yarns is located in the centre of the side covering panel 16.

A support 23 for various yarn guide members is located on the outside of the housing 16 for each of the yarns 20 led from the yarn guide support 14 over the yarn guide roller unit 19. Support 23 is pivotable out of an operative position shown in FIGS. 1 and 2 to a position 23*a* seen in FIG. 2 about a pivot axle 24 located on the underside of the housing 16 and common to a number of supports 23 arranged one behind the other.

In FIG. 4 such a pivotable support 23 is shown alone. It has at its lower end an aperture for reception of the said pivot axle 24. At its upper free end is located a yarn guide ring 25 and underneath that a yarn brake 26. In the embodiment shown, the brake comprises, in known manner, two brake discs spring-urged against one another, between which the yarn 20 is guided. The braking force of the yarn brake 26 can be adjusted by means of an electric adjustment motor 27 or an adjustment spindle which ends in a knob 28. Underneath the yarn brake 26, and thus behind the yarn brake 26 in the direction of yarn movement, are located two further yarn guide rings 29 and 30. The yarn guide ring 30 is secured in a projecting part 23*b* of the pivotable support 23. The yarn guide rings 29, 30 can also be replaced by ball-mounted yarn rollers 56 and 57 to be seen in FIG. 3. Between the two yarn guide rings 29 and 30 is located a yarn guide ring 31, which is mounted at the free end of a pivoted lever 32 serving as a take-up tensioner. The take-up tensioner/pivoted lever 32 is shown in FIG. 4 in its operative position in which it is held by the yarn tension with its yarn guide ring 31 between the yarn guide rings 29 and 30, and also in its take-up position 32*a* in which it is pivoted outwardly by a spring 34 acting behind its pivot point 33. Behind the yarn guide ring 30 is provided a yarn clamp 35 as an auxiliary member for clamping the end 20*a* of the yarn during the threading of a yarn in the yarn tensioning device. In the operative position of the support 23, the support extends with its projecting part 23*b* and thus with the yarn guide ring 30 and the yarn clamp 35 into the opening 22 of the housing 16.

In the central part of the support 23, at the position 36, is articulated an end of a safety strap 37, which has a longitudinal slot 38, into which extends a guide pin 39 secured to the covering panel 16. The safety strap 37 serves to stabilize the support in its swung-out position 23*a* seen in FIG. 2. In the lower part of the support 23 an adjustment disc 40 is mounted by which the take-up tension applied to the pivoted lever 32, of the yarn take-up by the tension spring 34 is adjustable. In the region of the pivot point 33 of the pivoted lever 32 a coaxial positioning disc 41 is provided by which a control stop 42 or other control member operative upon movement of the pivoted arm 32 beyond a predetermined pivot position can be adjusted. The pivoted lever 32 slides over, for example, a potentiometer or a corresponding contact-free step switch formed by a sensing strip 43, by which the pivot position of the yarn take-up and thus the pivot position of the yarn guide ring 31 can be established by evaluation in an electronic device, not shown, to determine the length of the yarn.

FIG. 2 shows one of the pivotable supports 23 in its swung-out position 23*a* to which it is brought for threading a yarn 20 drawn from a yarn supply unit 44. With the support swung out, the yarn 20 is led first through the yarn guide ring 25, through the following yarn brake 26, and through the three following yarn guide rings 29, 31 and 30 and is then held fast by its end in the yarn clamp 35. Next the support 23 is swung back again into its operative position against the covering panel 16, whereby its projecting part 23*b* with the yarn guide ring 30 and the yarn clamp 35 moves through the housing aperture 22 to a position behind the covering panel 6. The operator can now grasp the end 20*a* of the yarn behind the covering panel 16, release it from the yarn clamp 35 and thread it further to a yarn feeder 45 shown only schematically in FIG. 2.

FIG. 3 show the support of the yarn tension device whilst the flat knitting machine is operating and during a yarn take-up procedure in which the yarn 20 is pulled back from the yarn feeder 45 through the yarn guide ring 30 by the outwardly moved pivoted lever 32. The removal of yarn from the yarn feed unit 44 is prevented by the yarn brake 26.

FIGS. 5 and 6 show details of a yarn guide roller unit 19. The yarn guide roller unit 19 comprises a central supporting member 46 provided with a longitudinal slot 47 for a clamping screw 48 and carrying an axle 49 extending to both sides thereof. Onto both extending parts of the axle 49, ball mounted guide rollers 50 with intermediate profiled spacing discs 51 are pushed one behind the other and are secured by nuts 52 engaged on the screw-threaded ends of the axle 49. The profiled spacing discs 51 have, in each case, a radial arm 53 which is provided with an inclined safety finger 54 and a rectangular aperture 55. The spacing discs with the safety finger 54 are cast in one piece from metal or synthetic material. When the yarn guide rollers 50 and the spacing discs 51 with their radial arms aligned are threaded on, the free end 54*a* of an inclined safety finger 54 enters, in each case, the aperture 55 of the adjacent spacing disc 51. Thus, the completer space between two spacing discs 51 is bridged by the safety finger 54 and the escape of a yarn laid between the radial arms 53 of two adjacent spacing discs 51 is impeded. A yarn can, however, be introduced into the intermediate space by hand, round the pointed end 54*a* projecting into an aperture 55.

We claim:

1. A yarn tensioning device for flat knitting machines having, for each yarn which is provided for, yarn guide members, at least one yarn brake, and a spring-loaded pivoted lever carrying a yarn guide member and located between two yarn guide members, to serve as take-up tensioner, characterised in that the take-up tensioner (31/32) and at least the yarn guide members (29, 30, 56, 57) located in front of and behind it in the direction of yarn movement are mounted on a common support (23) pivotable out of its operative position for threading up, which has, additionally, behind the take-up tensioner (31/32) in the direction of yarn movement, a yarn clamp (35) to assist in threading up and to which the yarn (20) is led over a yarn guide roller (19) stationarily mounted on the machine housing (14).

2. A yarn tensioning device according to claim 1, characterised in that for each yarn (20) brought into use a separate pivotable support (23) is provided and the supports (23) are arranged adjacent one another on a common pivot axle (24) and further characterised in that the yarns (20) are guided to the supports (23) over yarn guide rollers (50) also arranged adjacent one another on a common stationary axle 49.

3. A yarn tensioning device according to claim 2, characterised in that the pivotable supports (23) are located outside a covering panel (16) of the flat knitting machine, which has at least one aperture (22) through which the yarn (20) coming from a support (23) enters and into which the yarn clamp (35) of the support (23) extends in the operative position of the support (23).

4. A yarn tensioning device according to claim 1, characterised in that it has an adjustable control stop (42) for alteration of the maximum pivot angle of the sprung-loaded pivoted lever (32) of the take-up tensioner.

5. A yarn tensioning device according to claim 1, characterised in that the pivoted lever (32) of the take-up tensioner acts on an electrical control element operatively dependent on the pivot angle.

6. A yarn tensioning device according to claim 5, characterised in that the electrical control element (43) is a potentiometer.

7. A yarn tensioning device according to claim 5, characterised in that the electrical control element is a step switch with a contact-free response.

8. A yarn tensioning device according to claim 2, characterised in that the ball-mounted yarn guide rollers (50) are pushed onto a common axle (49), secured on the machine frame, with profiled spacing discs (51) located between them, and the spacing discs have, in each case, a radial arm (53), which is provided with an inclined safety finger (54) and an aperture (55) and further characterised in that the radial arms (53) of all the spacing discs (51) are aligned with one another and the free end (54*a*) of the safety finger (54) of one radial arm (53) extends into the aperture (55) of a neighbouring radial arm (53).

9. A yarn tensioning device according to claim 8, characterised in that the profiled spacing discs (51) with their radial arm (53) and the safety finger (54) are produced as integral bodies of metal or synthetic material.

10. A yarn tensioning device according to claim 1, characterised in that at the outer end of the pivotable support (23), in front of the take-up tensioner (31/32) in the direction of yarn movement, is located an adjustable yarn brake (26).

* * * * *